US010350669B2

(12) United States Patent
Lin

(10) Patent No.: US 10,350,669 B2
(45) Date of Patent: Jul. 16, 2019

(54) CONTROLLING DEVICE FOR COIL SPRING BENDING TOOL AND CONTROLLING METHOD THEROF

(71) Applicant: Bingnan Lin, Taipei (TW)

(72) Inventor: Bingnan Lin, Taipei (TW)

( * ) Notice: Subject to any disclaimer, the term of this patent is extended or adjusted under 35 U.S.C. 154(b) by 0 days.

(21) Appl. No.: 15/542,696

(22) PCT Filed: Jan. 22, 2015

(86) PCT No.: PCT/CN2015/071309
§ 371 (c)(1),
(2) Date: Jul. 11, 2017

(87) PCT Pub. No.: WO2016/115706
PCT Pub. Date: Jul. 28, 2016

(65) Prior Publication Data
US 2017/0368595 A1 Dec. 28, 2017

(51) Int. Cl.
*B21F 3/02* (2006.01)
*B21F 3/06* (2006.01)
*B21F 35/00* (2006.01)

(52) U.S. Cl.
CPC ..... *B21F 3/02* (2013.01); *B21F 3/06* (2013.01); *B21F 35/00* (2013.01)

(58) Field of Classification Search
CPC ..... B21F 3/00; B21F 3/02; B21F 35/00
See application file for complete search history.

(56) References Cited

U.S. PATENT DOCUMENTS 5,452,598 A 9/1995 Cheng
2014/0046476 A1 2/2014 Walker et al.
2014/0290323 A1 10/2014 Weigmann et al.

FOREIGN PATENT DOCUMENTS

CN 2923099 Y 7/2007
CN 101559463 A 10/2009
(Continued)

OTHER PUBLICATIONS

Machine translation of CN 103781570 A, Sautter, pp. 1-14, translated on Mar. 26, 2018.*

*Primary Examiner* — Teresa M Ekiert
(74) *Attorney, Agent, or Firm* — Alan D. Kamrath; Mayer & Williams PC

(57) ABSTRACT

A control method and a device for a cutter shaped by a helical spring includes two controlling apparatuses (20) connected to two coil spring bending tools (10) respectively and including a lifting apparatus (30). The two controlling apparatuses (20) are arranged in the same assembly platform (40). The controlling apparatus (20) controls an amount of displacement of the stretching and retracting of the two coil spring bending tools (10). The amount of displacement of the coil spring bending tools (10) and the amount of up and down movement of the assembly platform (40) are controlled simultaneously by a motor (50). By applying the concept of relative coordinates, the requirements of control can be simplified from two two-dimensional control movements to three single-axis linear movements by using the coordinate of the center point (P3) of a spring coil as the origin of the coordinates for the movement of the spring outer diameter cutter. In the case that the distances of linear movement on the three axes are identical or at a fixed ratio, the advantage of reducing the number of motors is achieved.

2 Claims, 3 Drawing Sheets

(56) References Cited

FOREIGN PATENT DOCUMENTS

| | | | | | |
|---|---|---|---|---|---|
| CN | 202387890 | U | | 8/2012 | |
| CN | 103781570 | A | * | 5/2014 | ..... B21F 3/02 |
| DE | 202007001747 | U1 | | 8/2007 | |

* cited by examiner

CONTROLLING DEVICE FOR COIL SPRING BENDING TOOL AND CONTROLLING METHOD THEROF

BACKGROUND OF THE INVENTION

1. Field of the Invention

The present invention relates to a controlling device and, more particularly, to a controlling device for a coil spring bending tool and to a controlling method thereof.

2. Description of Related Art

A device for controlling an outer diameter of a coil spring in a conventional coil spring forming machine has shortcomings of being produced for a high cost and of difficulty for operation. For example, most advanced countries like US or Europe normally use multi-axis numerical control motors to control an automatic machine. Japan uses two numerical control motors to control each coil spring bending tool of the conventional coil spring forming machine. Since at least four numerical control motors were used, an absolute coordinate is therefore adopted to the conventional coil spring forming machine.

The absolute coordinate is engaged of obtaining locations of each coil spring bending tool by calculating trigonometric functions from an absolute origin point. The complex calculation requires a high-end computer to complete and to further accomplish by various gearing devices. Especially for producing a coil spring with multiple diameters like hourglass-shaped, olive-shaped or cone-shaped, the numerical control motor sometimes needs to wait for the high-end computer to complete the complex calculation which leads to a cost increase and which prevents automation of a small size coil spring forming machine.

To overcome the shortcomings, the present invention provides a controlling device for a coil spring bending tool to mitigate or obviate the aforementioned problems.

SUMMARY OF THE INVENTION

In order to avoid complex calculation of the conventional coil spring forming machine when forming a coil spring with multiple diameters, the present invention provides a controlling device for a coil spring bending tool comprising:

at least two coil spring bending tools for bending a spring wire;

at least two controlling apparatuses connected with the at least two coil spring bending tools and being mounted on an assembly platform;

a lifting apparatus controlling a height displacement of the assembly platform; wherein:

the at least two controlling apparatuses control displacements of the at least two coil spring bending tools;

the displacements of the at least two coil spring bending tools are adjusted according to a radius of a coil spring;

the displacements of the at least two coil spring bending tools are proportional to the radius of the coil spring;

a center point of the coil spring is a virtual reference point;

the height replacement is the assembly platform being moved by the at least two controlling apparatuses from the virtual reference point according to the radius of the coil spring; and the height replacement is proportional to the radius of the coil spring.

According to the above-mentioned features, the present invention has advantages a follows.

1. The conventional coil spring forming machine was operated by an absolute origin point and an absolute coordinate which leads to a complex calculation process. The present invention is able to solve the problem of the conventional coil spring forming machine by using the virtual reference point and the relative coordinate for a simpler calculation process. The present invention is operated by controlling the displacement of the coil spring bending tools being adjusted according to the radius of the coil spring which leads to a simpler and one-dimensional calculation.

2. Since the controlling method of the coil spring bending tools is simplified, the present invention may result in costs being down by operating multiple controlling apparatuses with one motor through a power transmission unit like a belt set, a gear set or a chain set.

Other objectives, advantages and novel features of the invention will become more apparent from the following detailed description when taken in conjunction with the accompanying drawings.

REFERENCE NUMBERS IN THE DRAWINGS

Figure 1:
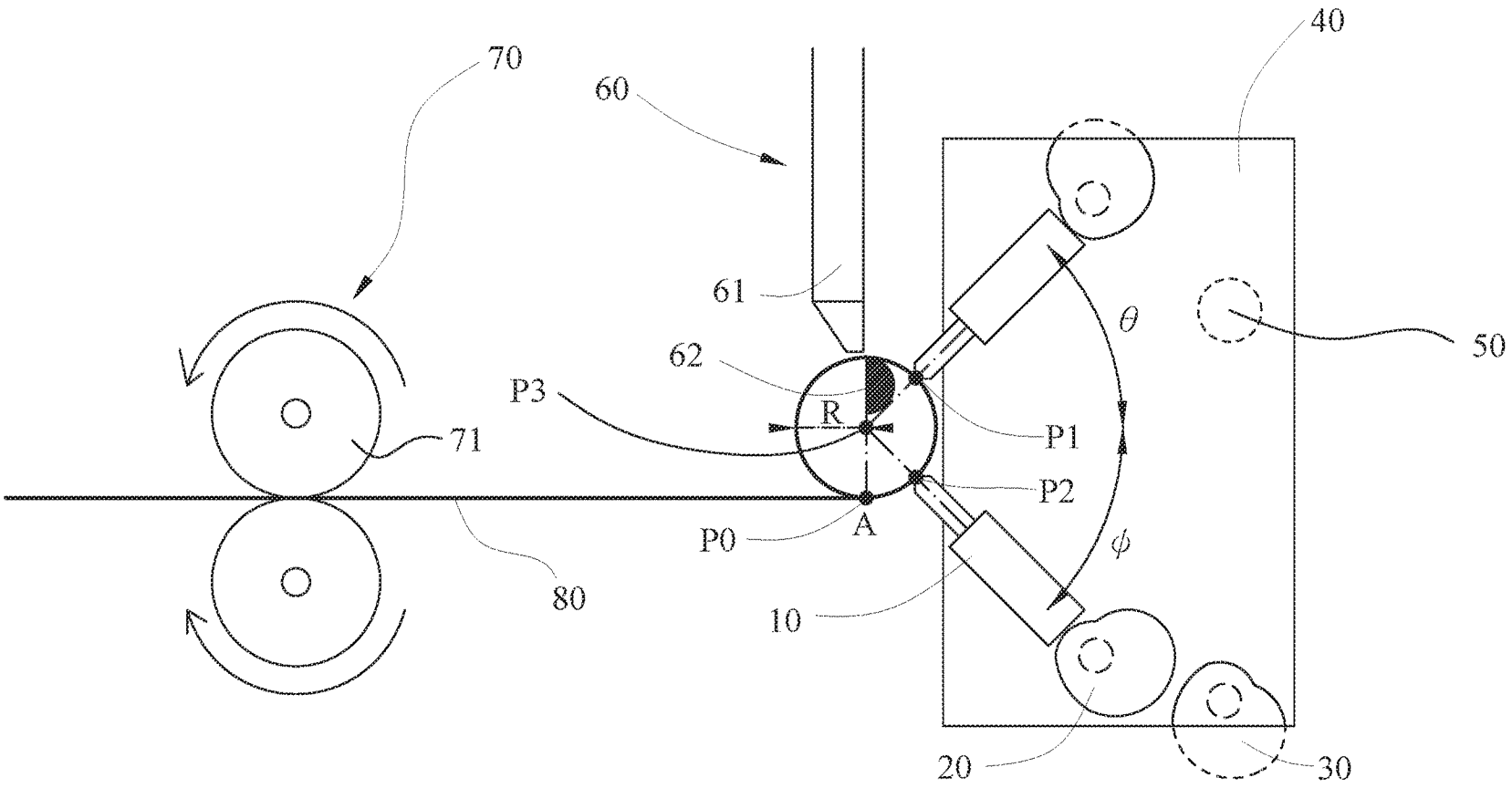
FIG. 1 is a schematic diagram of a controlling device for a coil spring bending tool in accordance with the present invention.

10 coil spring bending tool
20 controlling apparatus
30 lifting apparatus
40 assembly platform
50 motor
60 cutting assembly
61 cutting knife
62 cutting board
70 wire feeding assembly
71 fixed rollers
80 spring wire
A initial point
P0 original point of the controlling device of the present invention
P1, P2 touch points of coil spring bending tools 10 with the surfaces of the coil spring
P3 coordinate of center point of the coil spring
R, r radius of the coil spring
Z1, Z2 displacement
Z3 height displacement

DETAILED DESCRIPTION OF THE PREFERRED EMBODIMENT

Figure 2:
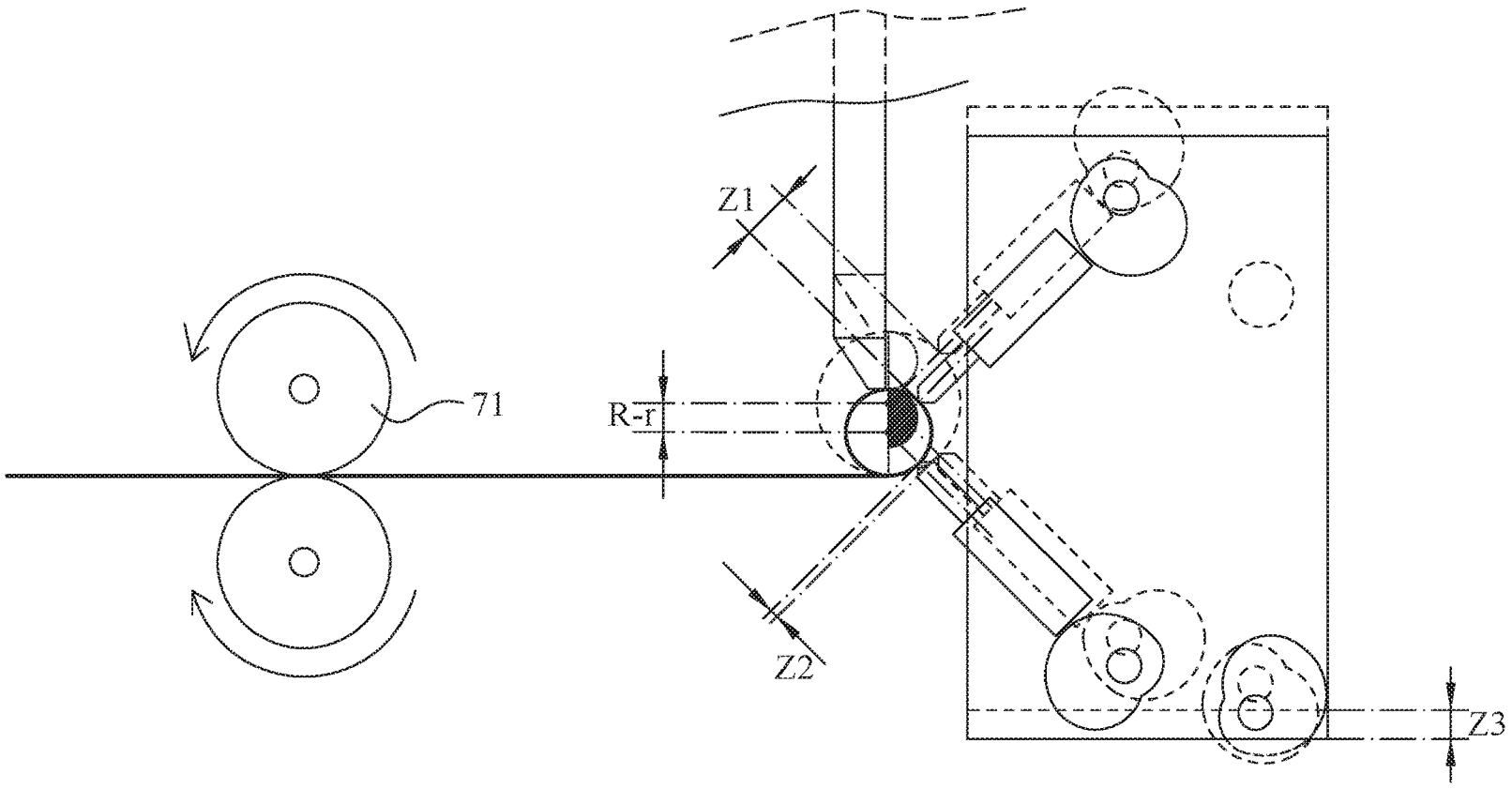
FIG. 2 is a schematic diagram for showing movements of a bending tool in accordance with the present invention.

With reference to FIG. 1 and FIG. 2, a controlling device for a coil spring bending tool of the present invention comprises a wire feeding assembly 70, a cutting assembly 60, at least two coil spring bending tools 10, at least two controlling apparatuses 20, a lifting apparatus 30, an assembly platform 40 and a motor 50.

The wire feeding assembly 70 comprises two fixed rollers 71 dragging out a spring wire 80 and forwarding the spring wire 80 to the nearby at least two coil spring bending tools 10. The at least two coil spring bending tools 10 provide a bending force to bend the spring wire 80 into a coil spring. A radius of the coil spring being produced by the present invention is controlled by distances between the at least two coil spring bending tools 10 with a virtual reference point. The virtual reference point is a center point of the coil spring. The center point of the coil spring is a crossing point between hypothesis extension lines extended from touch points of the at least two coil spring bending tools 10. When the distance between the at least two coil spring bending tools 10 and the virtual reference point is closer, the radius of the coil spring becomes smaller.

With reference to FIG. 1, after passing through an initial point, the spring wire 80 is firstly bent by the coil spring bending tool 10 being set up at the bottom of the controlling device of the present invention. The spring wire 80 then is forwarded to the coil spring bending tool 10 being set up at the top for bending again to form the coil spring. The coil spring then is cut by the cutting assembly 60 according to a free height of the coil spring. The cutting assembly 60 comprises a cutting knife 61 and a cutting board 62. The cutting knife 61 cuts the coil spring on the cutting board 62 with the coil spring being fixed thereon.

Each coil spring bending tool 10 is respectively connected with each controlling apparatus 20. The at least two controlling apparatuses 20 control the distance between the at least two coil spring bending tools 10 and the virtual reference point to form the coil spring with different radiuses. The at least two controlling apparatuses 20 are mounted on the assembly platform 40. A tip of the coil spring bending tool 10 is continually contacted with an outer surface of the coil spring. The distance between the tip of the coil spring bending tool 10 and the virtual reference point is maintained to be equidistance, so that a displacement of the at least two coil spring bending tools 10 will remain the same while the radius of the coil spring is changing. The aforementioned displacement is an extend or retraced distance of the at least two coil spring bending tools 10 when changing the radius of the coil spring. Moreover, according to a mechanical tolerance or demands of actual use, the displacement of the at least two coil spring bending tools 10 is proportional to the radius of the coil spring. In the first embodiment of the present invention, the controlling apparatus 20 may be, but is not limited to, a screw set, a cam set, a gear set or a combination thereof.

When three coil spring bending tools 10 are used in the second embodiment of the present invention, the third coil spring bending tool 10 may be placed between the first and second coil spring bending tools 10. The third coil spring bending tool 10 may provide an extra bending force and may prevent distortion of the coil spring away from a perfect circle according to the material property or radius of the spring wire 80.

The lifting apparatus 30 is connected with the assembly platfomi 40 to adjust a height displacement of the assembly platform 40. The height displacement is a distance between the assembly platform 40 and ground. The virtual reference point will adjust according to the displacement of the assembly platform 40. The controlling apparatus 20 controls the height displacement of the assembly platform 40 with respect to an absolute point of the present invention.

Figure 3:
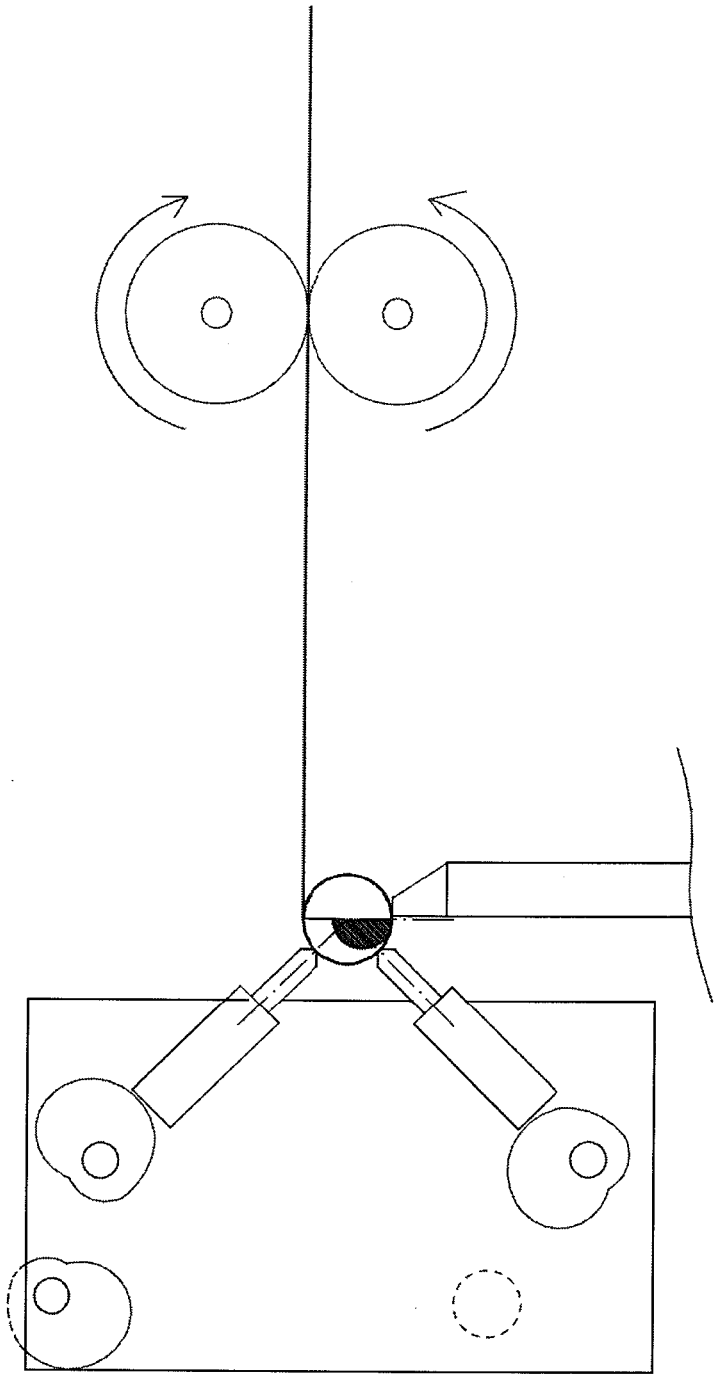
FIG. 3 is a schematic diagram of movements of a controlling device for a coil spring bending tool in accordance with the present invention.

With reference to FIG. 3, a third embodiment of the present invention is disclosed. The height between the virtual reference point and ground is changing according to the radius of the coil spring when the initial point A was fixed. For example, the height of the virtual reference point is vertically raised as the radius of the coil spring increased. As the height of the virtual reference point is being raised, the lifting apparatus 30 will also vertically lift the assembly platform 40 correspondingly. In the third embodiment of the present invention, the controlling apparatus 20 may be, but is not limited to, a screw set, a cam set, a gear set or a combination thereof.

The motor 50 provides electric power to the at least two controlling apparatuses 20 and the lifting apparatus 30. The electric power may be provided to the controlling apparatuses 20 and the lifting apparatus 30 individually by several motors 50 when applied to a large scale machine. The motor 50 may be, but is not limited to, a stepper motor or servo motor. The motor 50 may output mechanical power to the controlling apparatuses 20 and the lifting apparatus 30 by a power transmission unit like a set of a belt, a gear, a chain, a connecting rod or a combination thereof.

In order to simplify the whole construction of the present invention and reduce the usage of the motor 50 or its relevant power transmission unit, the motor 50, the at least two controlling apparatuses 20 and the lifting apparatus 30 may be connected as desired. For instance, the motor 50 may activate the controlling apparatus 20 and the lifting apparatus 30 respectively through the power transmission unit as the controlling apparatus 20 and the lifting apparatus 30 are working separately.

The motor 50 may also activate the at least two controlling apparatuses 20 and the lifting apparatus 30 by the following examples.

The motor 50 may provide power to the at least two controlling apparatuses 20 through the power transmission unit when one of the controlling apparatus 20 is connected and synchronized with the lifting apparatus 30.

The motor 50 may provide power to the lifting apparatus 30 through the power transmission unit when the lifting apparatus 30 is connected with a transmission shaft of the motor 50 and is synchronized with the controlling apparatuses 20.

The motor 50 may provide power to the controlling apparatus 20 that doesn't connect to the lifting apparatus 30 through the power transmission unit when the controlling apparatus 20 is connected and synchronized with the lifting apparatus 30 and further connected with the motor 50.

Moreover, the controlling apparatus 20 and the lifting apparatus 30 may be activated by multiple motors 50 respectively.

The displacement of the at least two coil spring bending tools 10 and the height displacement of the assembly platform 40 is proportional to the radius of the coil spring.

With reference to FIG. 1, the initial point A defines as a original point P0 with a coordinate (X0=0, Y0=0). The radius of the coil spring defines as R. Touch points of the at least two coil spring bending tools 10 with the surfaces of the coil spring define as P1 and P2. The displacements of the at least two coil spring bending tools 10 define as Z1 and Z2. The height displacement of the assembly platform 40 defines as Z3. An angle between the at least two coil spring bending tools 10 with a virtual horizontal plane extended from the virtual reference point defines as θ. An angle between the at least two coil spring bending tools 10 with a virtual horizontal plane extended from the virtual reference point defines as Ψ. Distance between touch points P1, P2 and the virtual reference point equals to radius R. A coordinate of P3 is X3=0 and Y3=R. With reference to FIG. 2 and FIG. 3, as the radius R decreases into a smaller radius r, the radius of the coil spring, distances between touch points P1, P2 and the virtual reference point, displacements Z1, Z2 and Z3 will all become to radius R minus radius r (R-r). The controlling apparatus 20 will also adjust the at least two coil spring bending tools 10 to maintain angles the θ and Ψ constant. Meanwhile, the coordinate of P3 will become (X3=0, Y3=R-r) . Moreover, summation of the angles θ and Ψ(θ+Ψ) are less than 180 degrees, and are better between 90 degrees to 150 degrees. The controlling method disclosed by the present invention will not be effected even though angles θ and Ψ may be unequal.

Furthermore, the motor 50 may be connected with a control module. The control module may control power output of the motor 50 to the controlling apparatus 20 and the lifting apparatus 30. For example, the motor 50 may be controlled by the control module to activate the controlling apparatus 20 and the lifting apparatus 30 respectively through the power transmission unit. The motor 50 may also be controlled by the control module to activate the controlling apparatus 20 and the lifting apparatus 30 through the power transmission unit with only the controlling apparatus 20 or the lifting apparatus being connected with the motor 50.

In order to solve size distortion problems of the coil spring coming from a residual stress when bending the spring wire 80, the control module may connect with a testing module with testing and correcting steps of:

Step 1. comparing the size of the coil spring with a standard coil spring to obtain a difference value. The difference value may be caused by bouncing back of the spring wire 80 while bending it or by a location error of the coil spring bend tools 10.

The size of the coil spring may be measured by an image measurement method or an optical measurement method. The image measurement method may be achieved by filming the coil spring and calculating the difference value with the standard coil spring. The optical measurement method may be achieved by projecting a light beam to the coil spring and calculating a reflect time and an angle of the light beam to obtain the size of the coil spring.

Step 2. outputting a correction signal to the control module by the testing module according to the difference or the size measured by step 1. The control module controls the displacement of the at least two coil spring bending tools 10 and the height displacement of the assembly platform 40 according to the correction signal in order to eliminate the difference value.

Step 3. Re-measuring the difference value of reproduced coil spring and repeating steps 1 and 2 until the difference value is eliminated to a tolerance value.

For example, the diameter of the coil spring was preset on 5 cm. A diameter of the finished product of the coil spring was 5.2 cm due to the material property of the spring wire 80. The difference value 0.2 cm then was being measured by step 1. The control module will adjust the distance between touch points P1, P2 and the virtual reference into 2.4 cm, and the radius R becomes 4.8 cm according to the difference value 0.2 cm. The difference value 0.2 cm that comes from the material property of the spring wire 80 will be eliminated by reducing the radius of the coil spring. After re-measuring the radius of the reproduced coil spring after step 1 and step 2, the coordinates of the touch points P1 and P2 will be confirmed if the difference value is eliminated to the tolerance value. If the difference value is still over the tolerance value, step 1 and step 2 will be repeated after the difference value is eliminated to the tolerance value.

A length of the spring wire 80 dragged out from the wire feeding assembly 70 will be decided by a circumference of the coil spring according to the change of the displacement of the coil spring bending tools 10 and the radius of the coil spring.

Above-mentioned testing and correction method always controls the length of the spring wire 80 dragged out from the wire feeding assembly 70 according to the preset diameter of the coil spring but the difference value. In above-mentioned embodiment, the length of the coil spring dragged out from the wire feeding assembly 70 will be decided by the preset diameter 5 cm of the coil spring but the difference value 4.8 cm.

According to the above-mentioned features, the present invention has advantages as follows.

3. The conventional coil spring forming machine was operated by an absolute origin point and an absolute coordinate which leads to a complex calculation process. The present invention is able to solve the problem of the conventional coil spring forming machine by using the virtual reference point and the relative coordinate for a simpler calculation process. The present invention is operated by controlling the displacement of the coil spring bending tools 10 being adjusted according to the radius of the coil spring which leads to a simpler and one-dimensional calculation.

4. Since the controlling method of the coil spring bending tools 10 is simplified, the present invention may result in costs being down by operating multiple controlling apparatuses 20 with one motor 50 through a power transmission unit like a belt set, a gear set or a chain set.

What is claimed is:

1. A controlling device comprising:

at least two coil spring bending tools for bending a spring wire;

at least two controlling apparatuses being connected with the at least two coil spring bending tools and being mounted on an assembly platform;

a lifting apparatus for controlling a height displacement of the assembly platform;

a motor providing power to the at least two controlling apparatuses and the lifting apparatus respectively; and a control module and a testing module connected with the motor, wherein:

the at least two controlling apparatuses control displacements of the at least two coil spring bending tools;

the displacements of the at least two coil spring bending tools are adjusted according to a radius of a coil spring, wherein the displacements of the at least two coil spring bending tools are equal to a changing of the radius of the coil spring;

a center point of the coil spring is a virtual reference point;

the height displacement is the assembly platform being moved by the at least two controlling apparatuses from the virtual reference point according to the changing of the radius of the coil spring;

the height displacement is proportional to the changing of the radius of the coil spring;

wherein:

the testing module is configured to film the coil spring and calculates a difference value of the coil spring;

the testing module is configured to output a correction signal to the control module according to the difference value; and the control module controls the displacement of the at least two coil spring bending tools and the height displacement of the assembly platform according to the correction signal in order to eliminate the difference value to a tolerance value.

2. The controlling device for coil spring bending tool as claimed in claim 1, wherein the at least two coil spring bending tools comprise three coil spring bending tools.

* * * * *